US009604708B2

(12) United States Patent
Tahar

(10) Patent No.: US 9,604,708 B2
(45) Date of Patent: Mar. 28, 2017

(54) MULTI-COLUMN TENSION LEG PLATFORM

(71) Applicant: Arcandra Tahar, Houston, TX (US)

(72) Inventor: Arcandra Tahar, Houston, TX (US)

( * ) Notice: Subject to any disclaimer, the term of this patent is extended or adjusted under 35 U.S.C. 154(b) by 0 days.

(21) Appl. No.: 14/708,165

(22) Filed: May 8, 2015

(65) Prior Publication Data

US 2015/0321735 A1 Nov. 12, 2015

Related U.S. Application Data

(60) Provisional application No. 61/990,471, filed on May 8, 2014, provisional application No. 62/049,410, filed on Sep. 12, 2014.

(51) Int. Cl.

| | |
|---|---|
| ***B63B 35/44*** | (2006.01) |
| ***B63B 21/50*** | (2006.01) |
| ***B63B 35/34*** | (2006.01) |
| ***B63B 1/10*** | (2006.01) |
| ***B63B 1/12*** | (2006.01) |

(52) U.S. Cl.

CPC ..... *B63B 35/4413* (2013.01); *B63B 1/107* (2013.01); *B63B 1/125* (2013.01); *B63B 21/502* (2013.01); *B63B 35/34* (2013.01); *B63B 35/44* (2013.01); *B63B 2001/126* (2013.01); *B63B 2001/128* (2013.01)

(58) Field of Classification Search

CPC ... B63B 21/50; B63B 21/502; B63B 2021/50; B63B 35/34; B63B 35/38; B63B 35/44; B63B 35/4413; B63B 2035/44; B63B 9/065

USPC ..... 114/256, 258–267

See application file for complete search history.

(56) References Cited

U.S. PATENT DOCUMENTS

| | | | | |
|---|---|---|---|---|
| 5,190,411 A * | 3/1993 | Huete | B63B 21/50 | 405/203 |
| 5,342,148 A * | 8/1994 | Huete | B63B 21/50 | 405/203 |
| 5,423,632 A * | 6/1995 | Ekvall | E02B 17/00 | 114/249 |
| 5,439,321 A * | 8/1995 | Hunter | B63B 21/502 | 166/350 |
| 5,439,324 A * | 8/1995 | Ekvall | B63B 59/02 | 405/202 |
| 5,486,070 A * | 1/1996 | Huete | B63B 21/50 | 405/202 |
| 5,651,640 A * | 7/1997 | Huete | B63B 21/50 | 166/350 |

* cited by examiner

*Primary Examiner* — Daniel V Venne

(57) ABSTRACT

A multi-column tension leg platform is an offshore floating structure that is used to facilitate production of natural resources contained below the seabed. The multi-column tension leg platform includes a hull which is used to keep the entire structure afloat. The structure also includes a topside which is mounted to the top of the hull. The topside is used as a surface for supporting workers and equipment. The hull is made up of a plurality of flotation columns and a plurality of pontoons. Both the plurality of flotation columns and the plurality of pontoons are positioned about a vertical central axis of the topside. The plurality of flotation columns and the plurality of pontoons are buoyant structures that are aligned vertically and are used to keep the topside above water. The plurality of pontoons is mounted amongst the plurality of flotation columns.

18 Claims, 14 Drawing Sheets

MULTI-COLUMN TENSION LEG PLATFORM

The current application claims a priority to the U.S. Provisional Patent application Ser. No. 61/990,471 filed on May 8, 2014 and claims a priority to the U.S. Provisional Patent application Ser. No. 62/049,410 filed on Sep. 12, 2014.

FIELD OF THE INVENTION

The present invention relates generally to floating offshore structures. More specifically, the present invention is a buoyant semi-submersible offshore platform which uses vertically configured flotation columns and pontoons to stay afloat. The present invention utilizes a unique arrangement of said flotation columns and pontoons to facilitate numerous anchoring and production methods.

BACKGROUND OF THE INVENTION

The present invention relates to improvements in motion characteristics, fabrication method, and the hull arrangement of a floating system intended for operating at sea with wet or dry-tree risers. The hull improvement in the present invention is related to a pontoon arrangement which makes the fabrication process easier and faster.

The present invention is developed to answer challenges in shallow water and marginal fields. One of the key challenges in marginal field development is the uncertainty of future production, where, often, production declines faster than predicted. Because of that, a production facility should be able to be relocated to other fields such that the service life of the facility can be used according to its design life. In other words, economic valuation of the production facility would be much better if options for relocation are made available.

Another challenge in shallow water development is subsidence which may be caused by many reasons. One of which is shrinking of the reservoir after production over many years. Unfortunately, the preferred solution for production platforms in shallow water is a fixed platform (jacket) which is not designed to handle subsidence well. The present invention is expected to handle subsidence easily.

Earthquakes are another challenge for the fixed platform. In some parts of the world, the prevalence of earthquakes may require more complex and expensive fixed platform designs. The present invention, however, is not greatly influenced by earthquakes because its nature is a floating platform.

One of the existing solutions for shallow water and marginal field development is using conventional semi-submersible offshore platforms which comprise a hull that has sufficient buoyancy to support a work platform above the water surface, as well as rigid and/or flexible piping or risers. The hull typically comprises a plurality of horizontal pontoons that supports a plurality of vertically upstanding columns, which in turn support the work platform above the surface of the water. The horizontal pontoons are costly and complicated in terms of operation and fabrication.

In general, the conventional semi-submersible offshore platform incorporates a conventional catenary chain-link spread-mooring arrangement to maintain its position over the well site. The motions of these types of semi-submersible platforms are usually relatively large, and accordingly, they require the use of "catenary" risers (either flexible or rigid) extending from the seafloor to the work platform and the heavy wellhead equipment is typically installed on the sea-floor, rather than on the work platform. The risers have a catenary shape to absorb the large heave (vertical motions) and horizontal motions of the structure. Due to their large motions, conventional semi-submersible platforms usually do not support top-tensioned risers.

During drilling or production operations, it is generally desirable to minimize the motion of the offshore platform to maintain the position of the platform over the well site and to reduce the likelihood of damage to the risers. One component of offshore platform motion is heave, which is the vertical linear displacement of the offshore platform in response to wave motion. For use in conjunction with top tensioned risers or dry tree solutions, the floating structure preferably has heave characteristics such that the strokes (relative motion between the hull and the risers) and the tension of the risers are within acceptable limits. Further, for use in conjunction with steel catenary risers or wet tree solutions, the floating structure preferably has heave characteristics such that the riser fatigue and strength requirements are within acceptable limits.

Accordingly, there remains a need in the art for a semi-submersible offshore platform with acceptable heave characteristics, and which can be manufactured more cost effectively and can be operated efficiently.

DETAILED DESCRIPTION OF THE INVENTION

Figure 1:
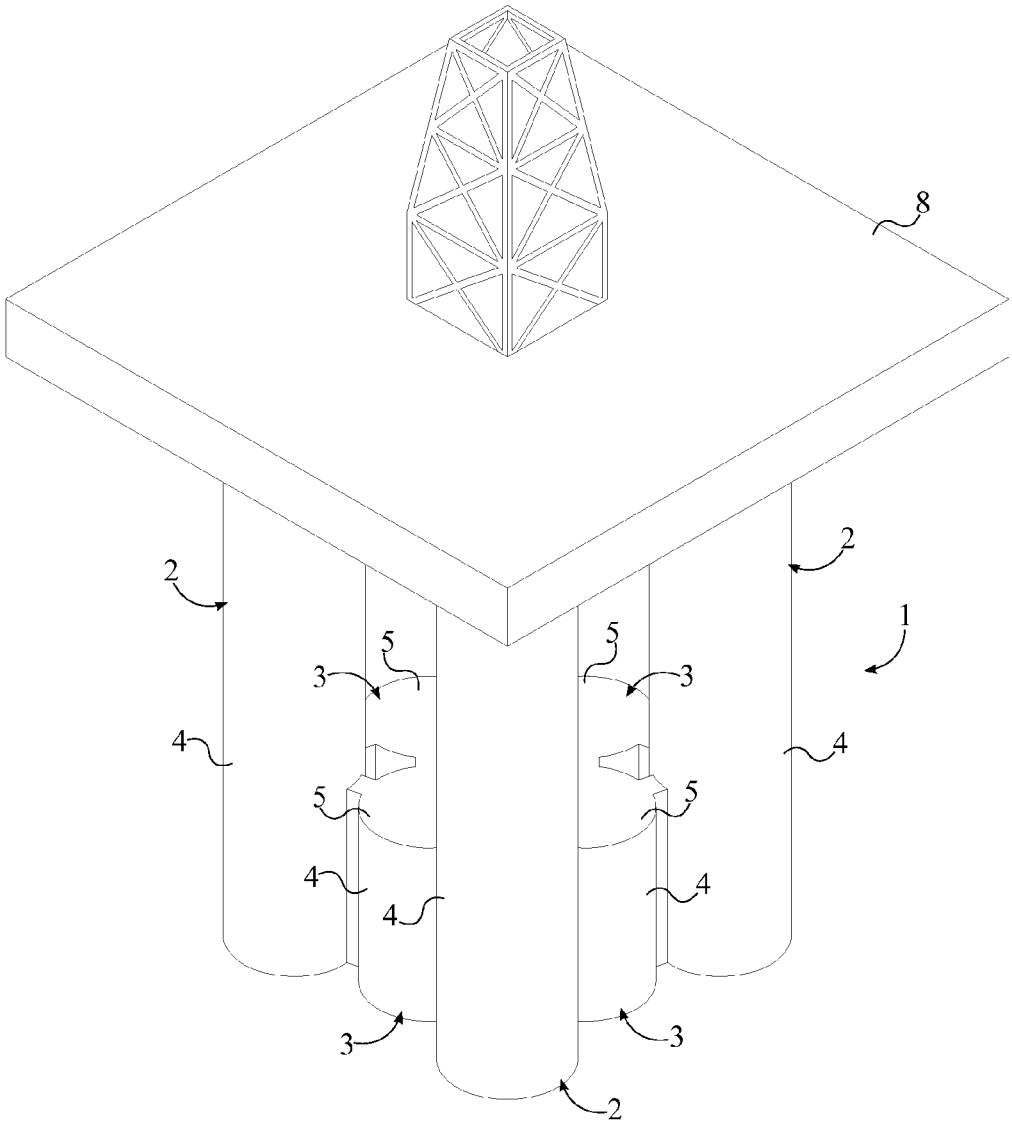
FIG. 1 is a perspective view of the present invention without the anchoring system and the plurality of risers.

All illustrations of the drawings are for the purpose of describing selected versions of the present invention and are not intended to limit the scope of the present invention.

With reference to FIGS. 1-5, the present invention is a multi-column tension leg platform that may be used to support oil and natural gas production, drilling, wind farms, and other offshore activities. The present invention comprises a hull 1 and a topside 8. The hull 1 is a large structure that is designed to float on a body of water and support the topside 8. The topside 8 is a large platform that is situated on top of the hull and provides a deck for supporting workers, equipment, utilities needed for a specific job. The hull 1 comprises a plurality of flotation columns 2 and a plurality of pontoons 3. Both the plurality of flotation columns 2 and the plurality of pontoons 3 are used to supply the necessary buoyant force to keep the present invention afloat. The plurality of flotation columns 2 and the plurality of pontoons 3 are both positioned radially about a vertical central axis 7 of the topside 8. This is essential for keeping the present invention balanced on the water. A lateral portion 4 for each of the plurality of flotation columns 2 and a lateral portion 4 for each of the plurality of pontoons 3 are aligned parallel to the vertical central axis 7. The plurality of pontoons 3 is laterally mounted amongst the plurality of flotation columns 2 such that the entire hull 1 is a rigid structure. Positioning the plurality of flotation columns 2 and the plurality of pontoons 3 in a vertical configuration helps to balance the present invention. Moreover, with this configuration, the plurality of flotation columns 2 and the plurality of pontoons 3 are arranged in a relatively compact manner.

Figure 6:
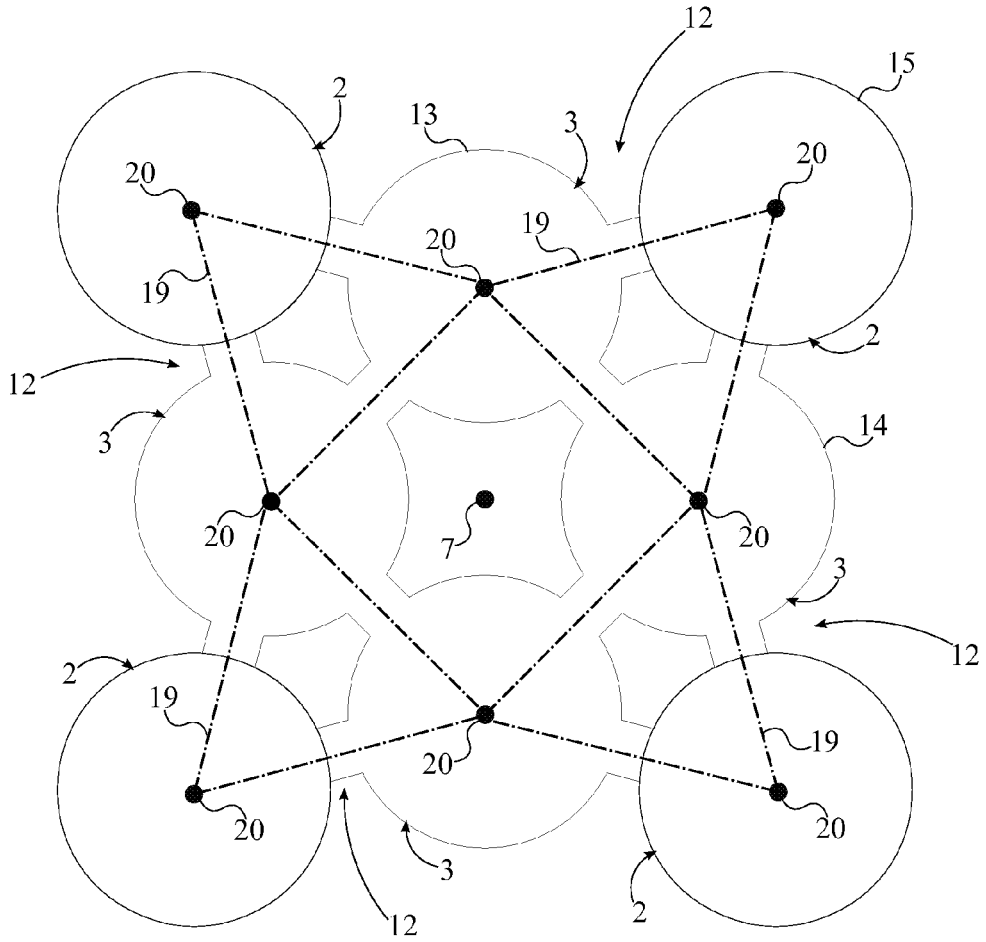
FIG. 6 is a top view of the hull of the present invention.

In a preferred embodiment of the present invention, the plurality of pontoons 3 is positioned adjacent to each other and the plurality of flotation columns 2 is peripherally positioned about the plurality of pontoons 3. This is shown in FIGS. 1-4. This arrangement facilitates a mooring method in which the anchoring system 9 is connected to the plurality of flotation columns 2. This arrangement also allows for easy access to any anchoring equipment. In this embodiment, the present invention further comprises a plurality of cells 12. Each of the plurality of cells 12, shown in FIG. 6, comprises an arbitrary pontoon 13 from the plurality of pontoons 3, an adjacent pontoon 14 from the plurality of pontoons 3, and an adjacent column 15 from the plurality of flotation columns 2. The plurality of cells 12 is radially positioned about the vertical central axis 7. Vertices of a triangular arrangement 19 are coincident with central axes 20 of the arbitrary pontoon 13, the adjacent pontoon 14, and the adjacent column 15. Because of this configuration, the hull 1 is evenly balanced on the water.

Figure 7:
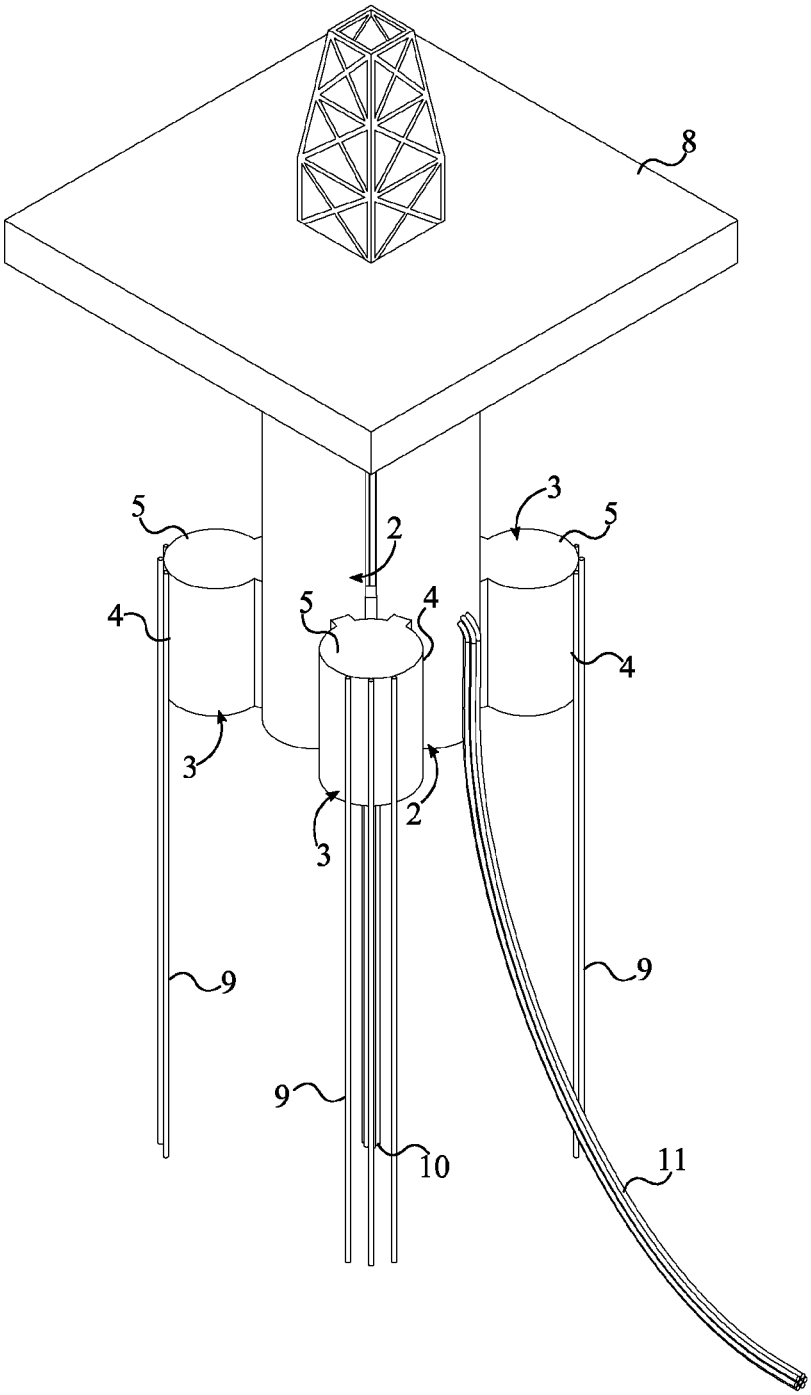
FIG. 7 is a top perspective view of an alternative embodiment of the present invention, wherein the plurality of flotation columns is encircled by the plurality of pontoons for the alternative embodiment.
Figure 8:
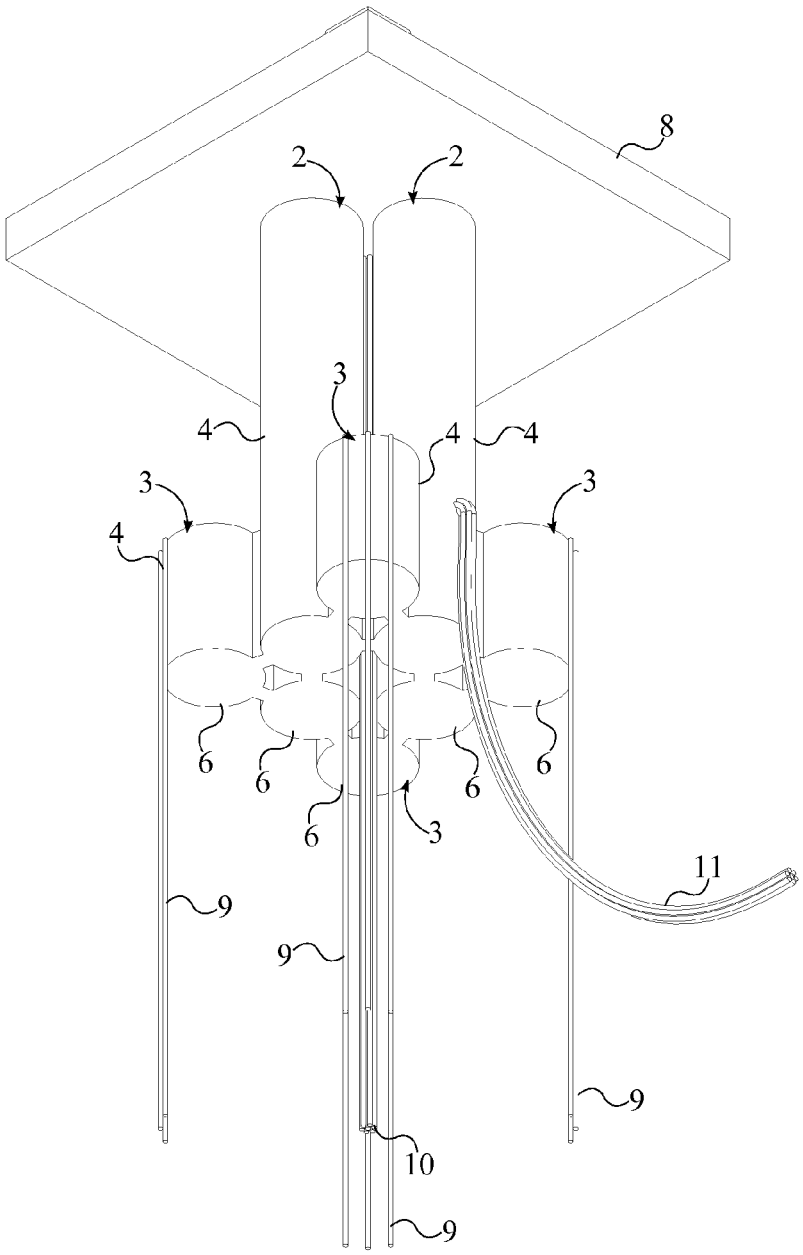
FIG. 8 is a bottom perspective view of the alternative embodiment of the present invention.
Figure 9:
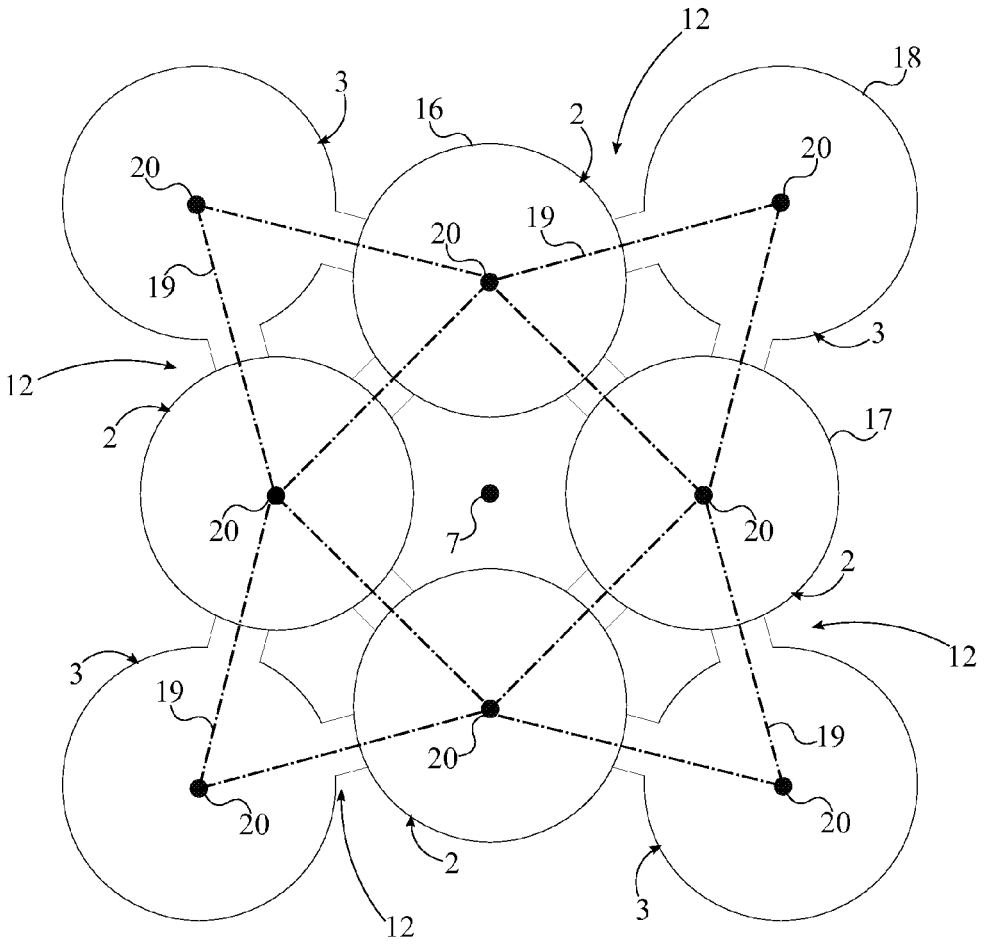
FIG. 9 is a top view of the hull for the alternative embodiment of the present invention.

In another embodiment of the present invention, the plurality of columns 2 is positioned adjacent to each other and the plurality of pontoons 3 is peripherally positioned about the plurality of flotation columns 2. This is shown in FIGS. 7-9. This arrangement facilitates a mooring method in which the anchoring system 9 is connected to the plurality of pontoons 3. This arrangement also allows for easy access to any anchoring equipment. In this embodiment, the present invention further comprises a plurality of cells 12. Each of the plurality of cells 12, shown in FIG. 9, comprises an arbitrary column 16 from the plurality of flotation columns 2, an adjacent column 17 from the plurality of flotation columns 2, and an adjacent pontoon 18 from the plurality of pontoons 3. The plurality of cells 12 is radially positioned about the vertical central axis 7. Vertices of a triangular arrangement 19 are coincident with central axes 20 of the arbitrary column 13, the adjacent column 14, and the adjacent pontoon 15. Because of this configuration, the hull 1 is evenly balanced on the water.

Figure 10:
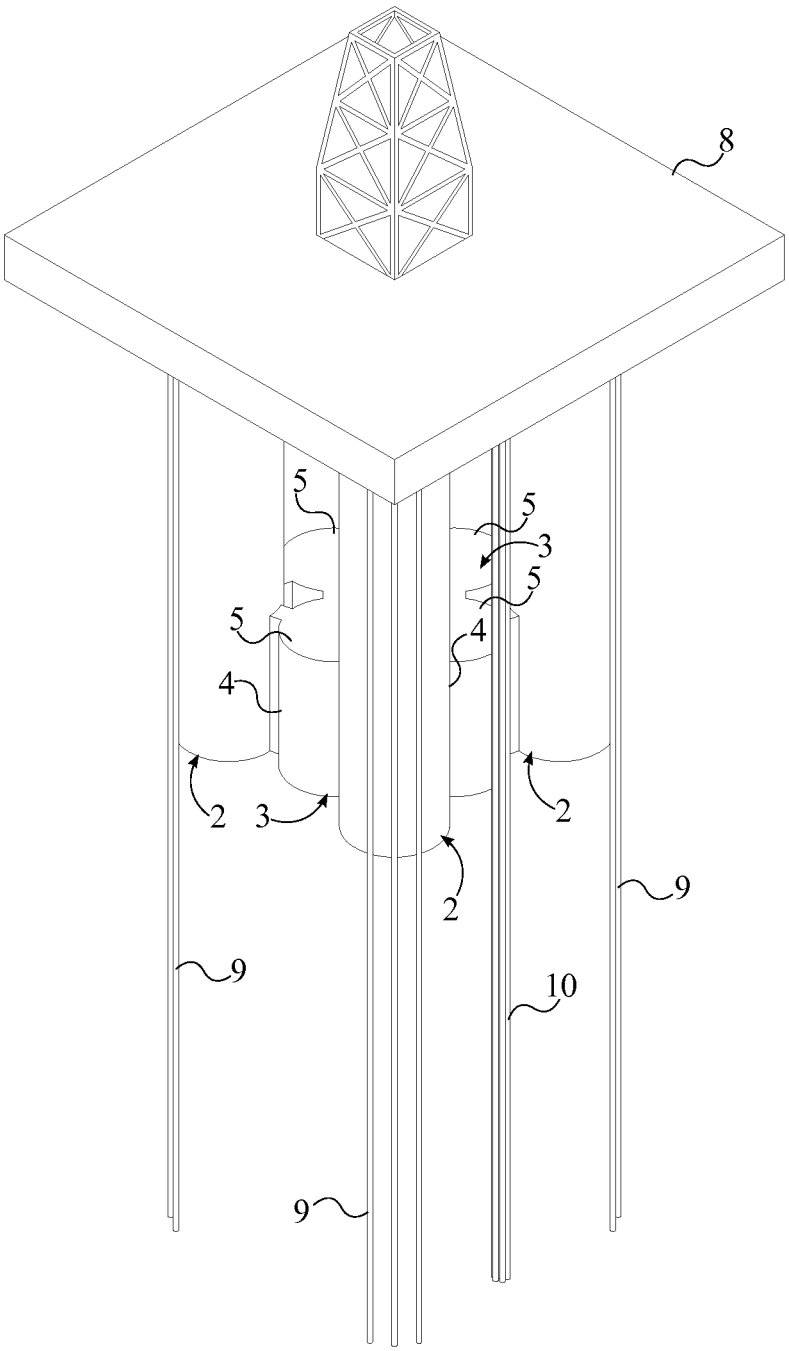
FIG. 10 is a perspective view of a first configuration of the present invention, wherein the plurality of top-tensioned risers is externally mounted to at least one of the plurality of pontoons for the first configuration.
Figure 11:
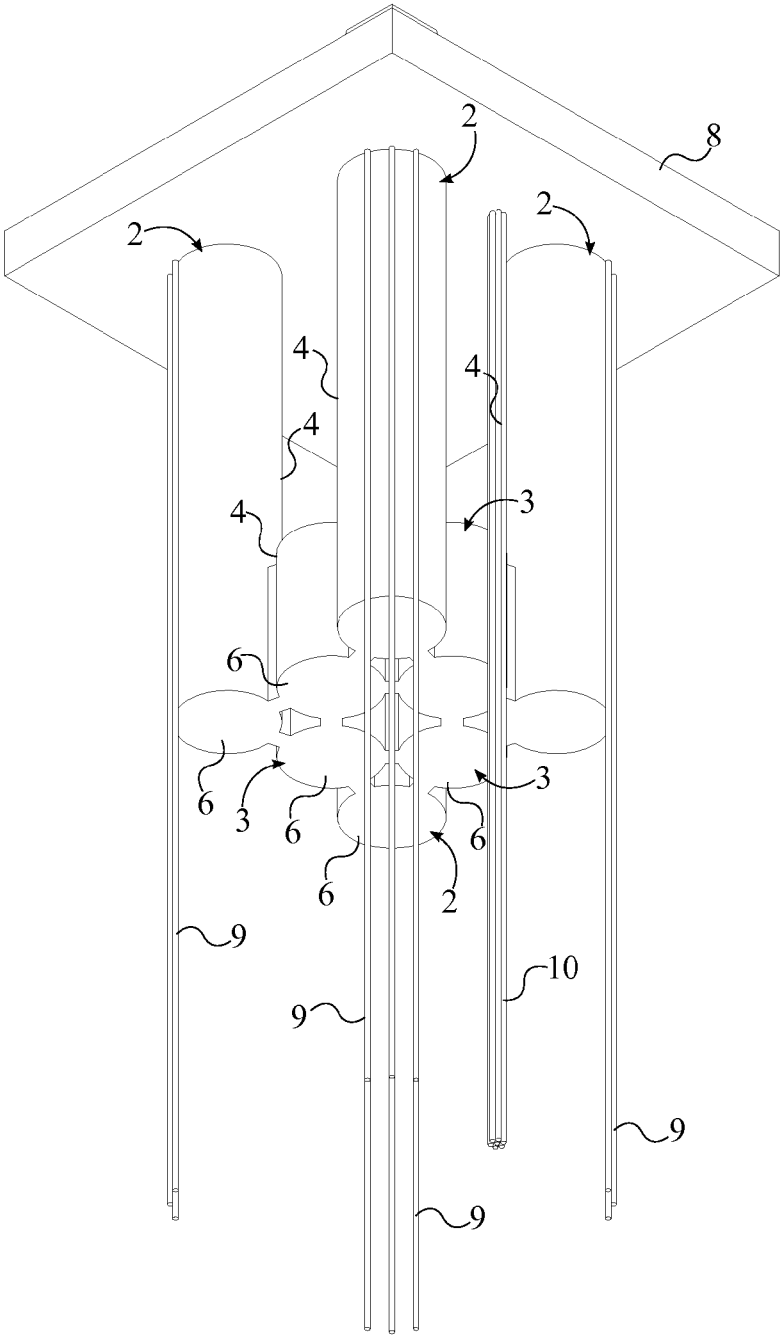
FIG. 11 is a bottom perspective view of the first configuration of the present invention.

In reference to FIGS. 7-8, the present invention comprises a plurality of top-tensioned risers 10. The plurality of top-tensioned risers 10 may be used for drilling or for transporting fluids between termination points such as a wellhead. In one embodiment of the present invention, the plurality of top tensioned risers 10 is mounted along the central vertical axis 7. In another embodiment of the present invention, shown in FIGS. 10-11, the plurality of top tensioned risers 10 is externally mounted to at least one of the plurality of pontoons 3. Either configuration of the plurality of top-tensioned risers 10 may be used based on specific applications for the present invention.

Figure 2:
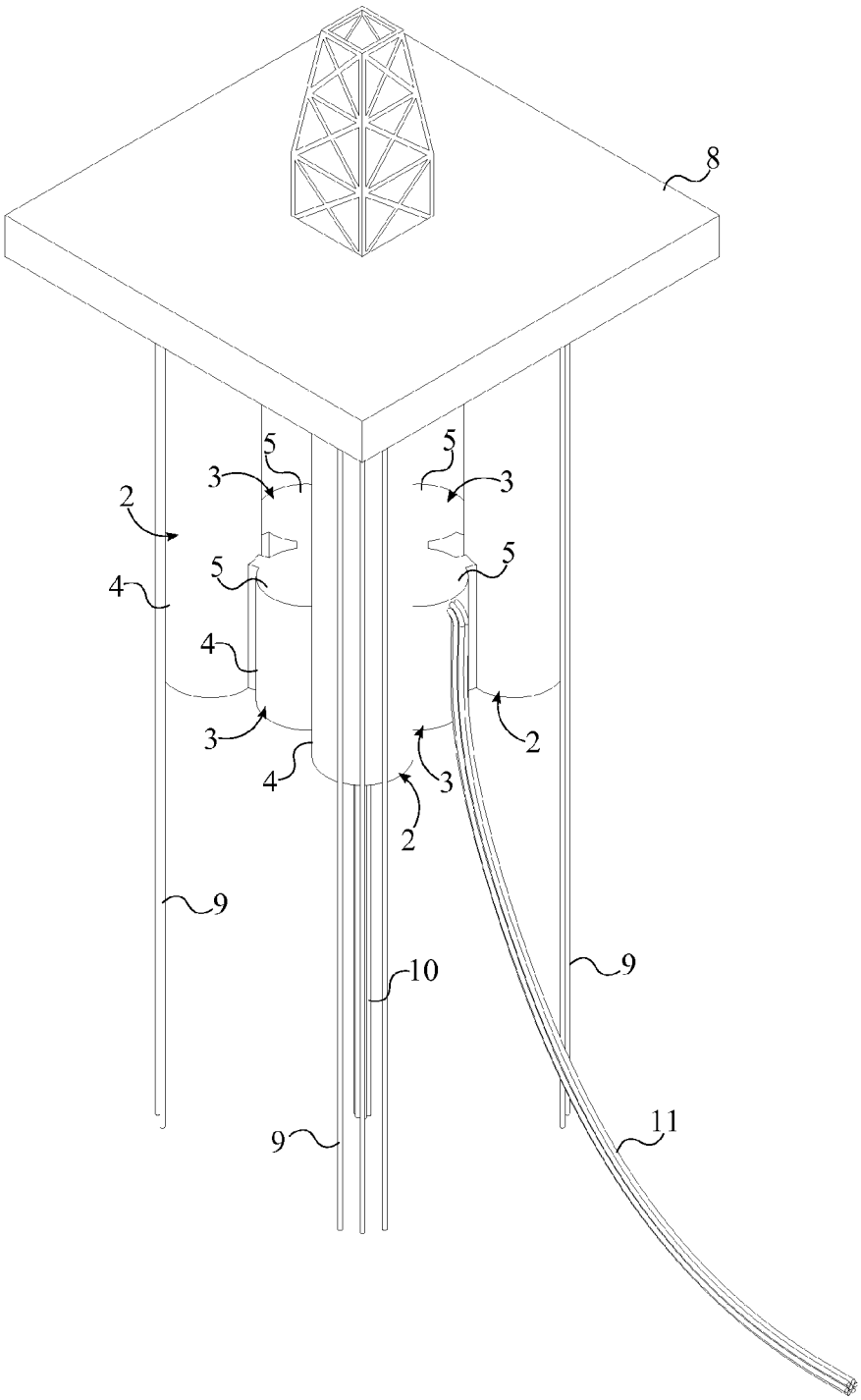
FIG. 2 is a top perspective view of the present invention.
Figure 3:
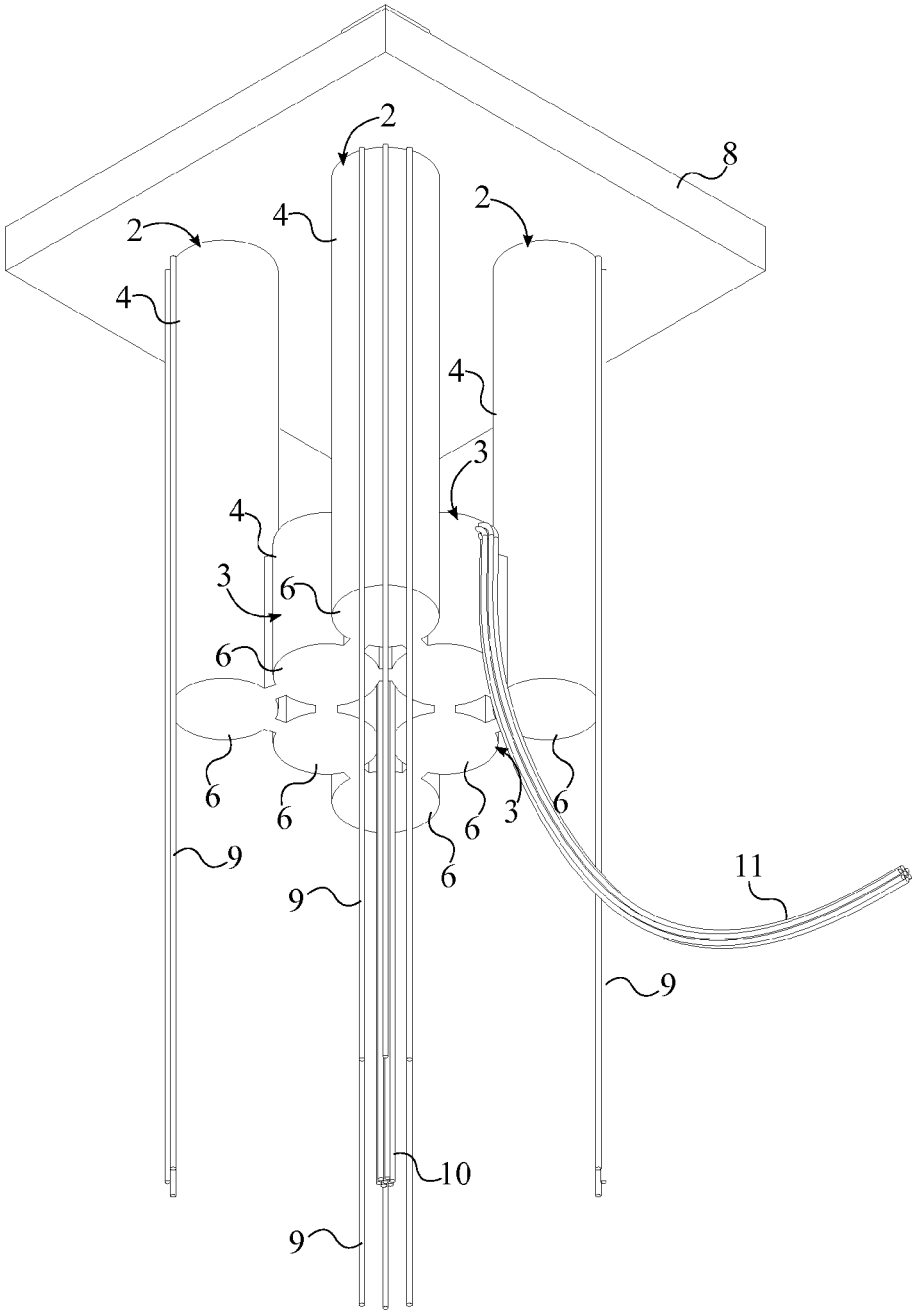
FIG. 3 is a bottom perspective view of the present invention.
Figure 4:
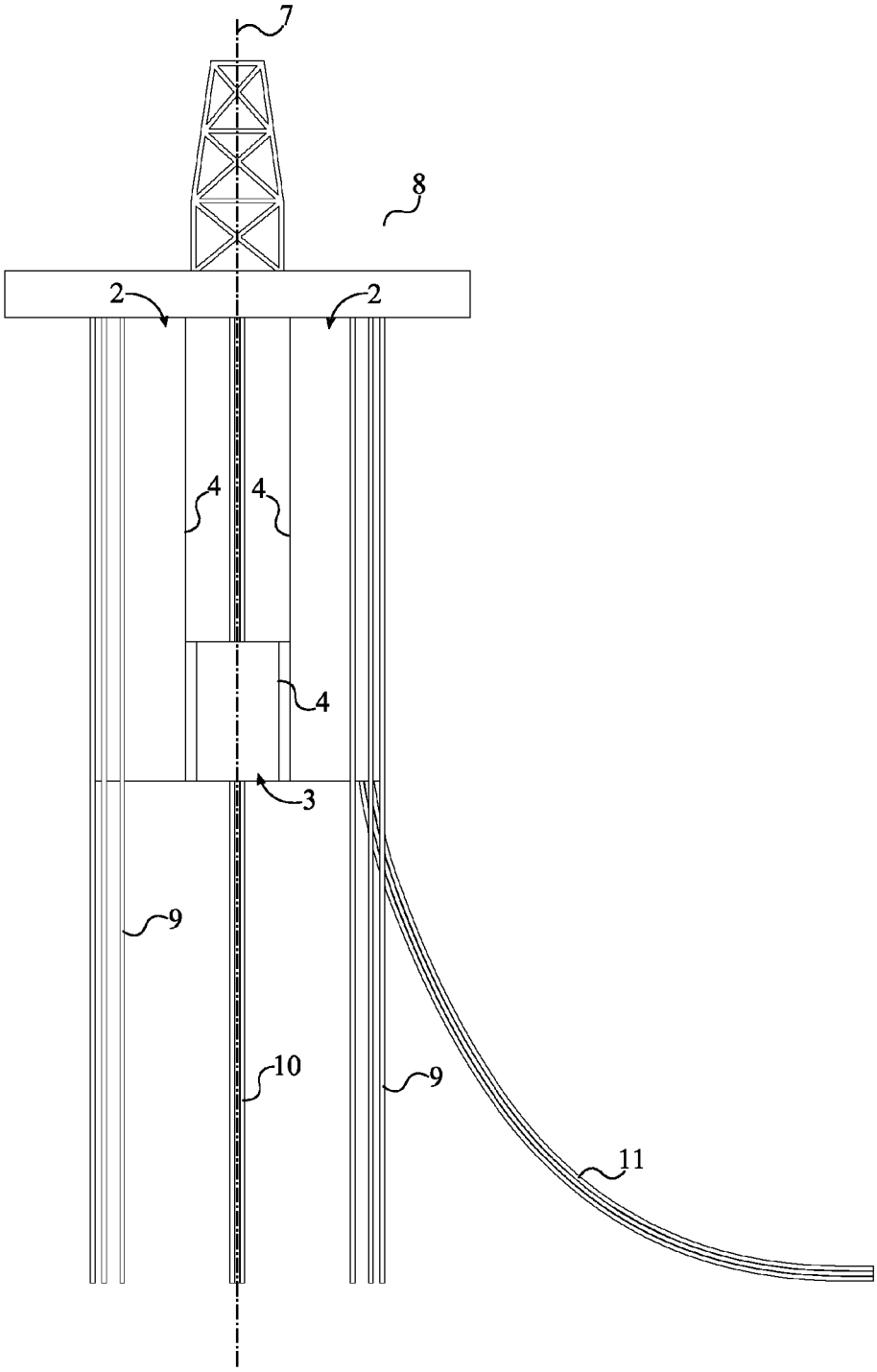
FIG. 4 is a front view of the present invention.
Figure 5:
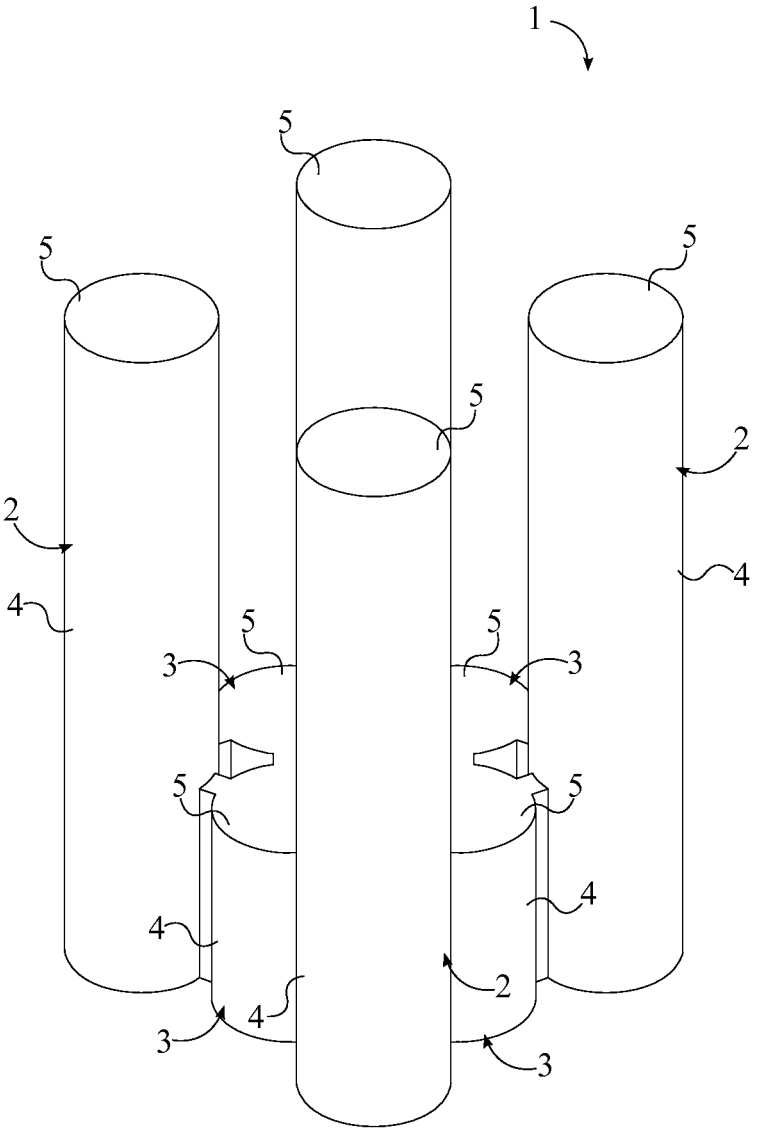
FIG. 5 is a perspective view of the hull of the present invention.

In reference to FIGS. 2-3, the present invention comprises a plurality of catenary risers 11. The plurality of catenary risers 11 may be used for transporting fluids between termination points such as a wellhead and a pipeline end terminator. In one embodiment of the present invention, the plurality of catenary risers 11 is mounted to at least one of the plurality of pontoons 3. In another embodiment of the present invention, shown in FIGS. 7-8, the plurality of catenary risers 11 is mounted to at least one of the plurality of flotation columns 2. Either configuration of the plurality of catenary risers 11 may be used based on specific applications for the present invention.

In reference to FIGS. 2-5, each of the plurality of flotation columns 2 and each of the plurality of pontoons 3 each comprise a first base 5, a second base 6, and a lateral portion 4. The lateral portion 4 is perpendicularly positioned between the first base 5 and the second base 6. Together, the first base 5, the second base 6, and the lateral portion 4 create a hollow container which may be filled with air allowing the present invention to float on water. The interior of each of the plurality of flotation columns 2 and each of the plurality of pontoons 3 may also be partially filled with water, iron ore, or other materials which can be used as a ballast. By doing this, the stability of the present invention can be optimized and the height in which the present invention floats above the water can be set as needed for specific applications. The topside 8 is mounted onto the first base 5 of each of the plurality of flotation columns 2. This positioning is necessary to ensure that the topside 8 is above water at all times.

Figure 12:
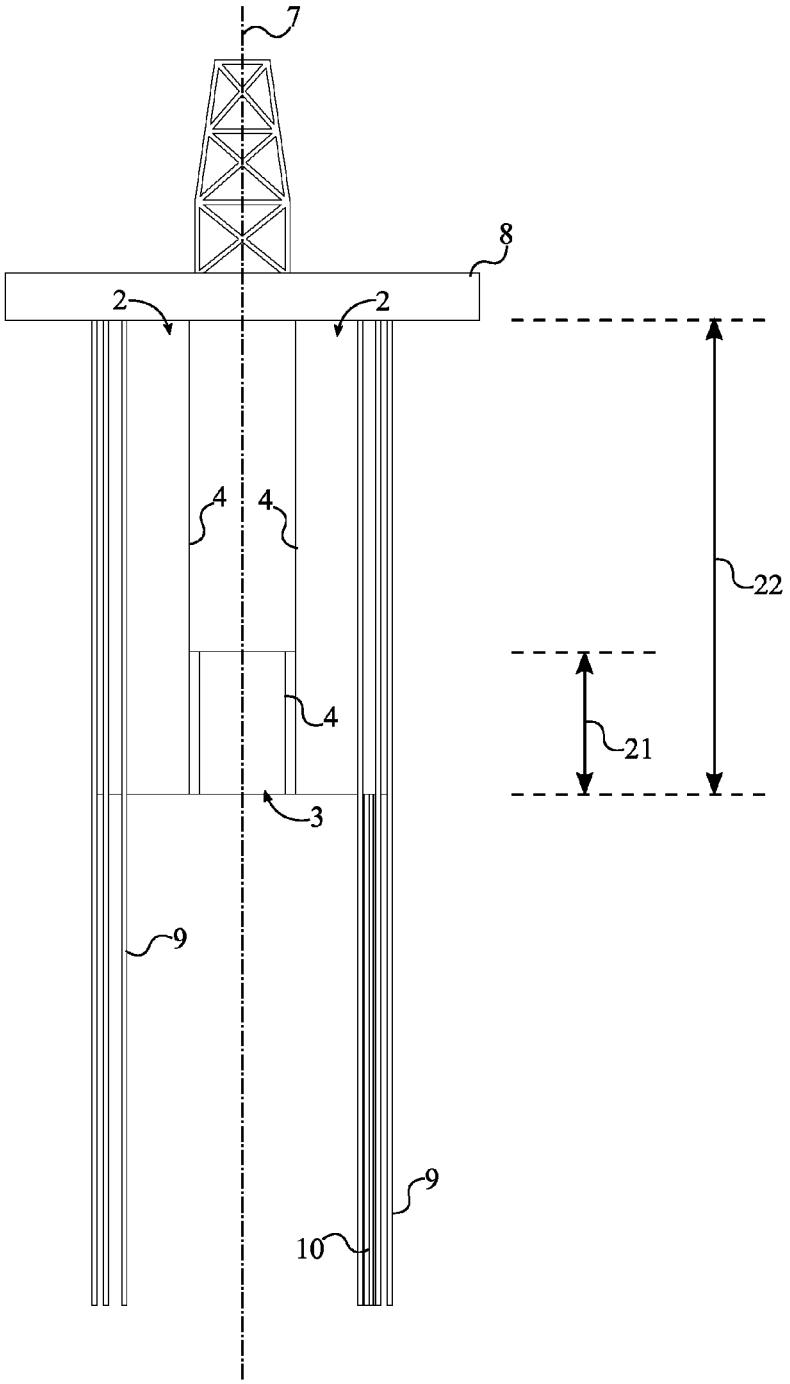
FIG. 12 is a front view of the first configuration of the present invention.
Figure 13:
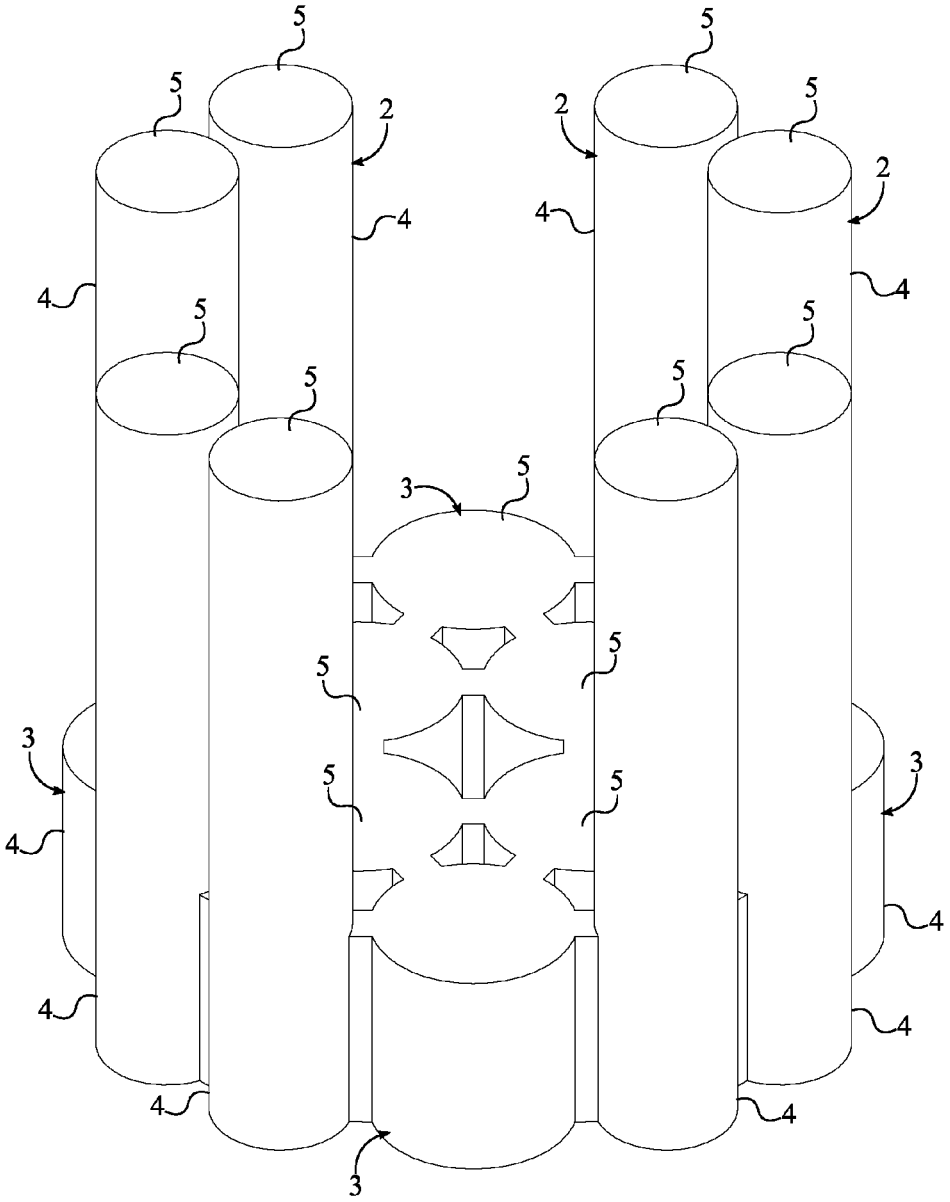
FIG. 13 is a perspective view of the hull of an alternative embodiment of the present invention which uses 8 flotation columns and 8 pontoons.
Figure 14:
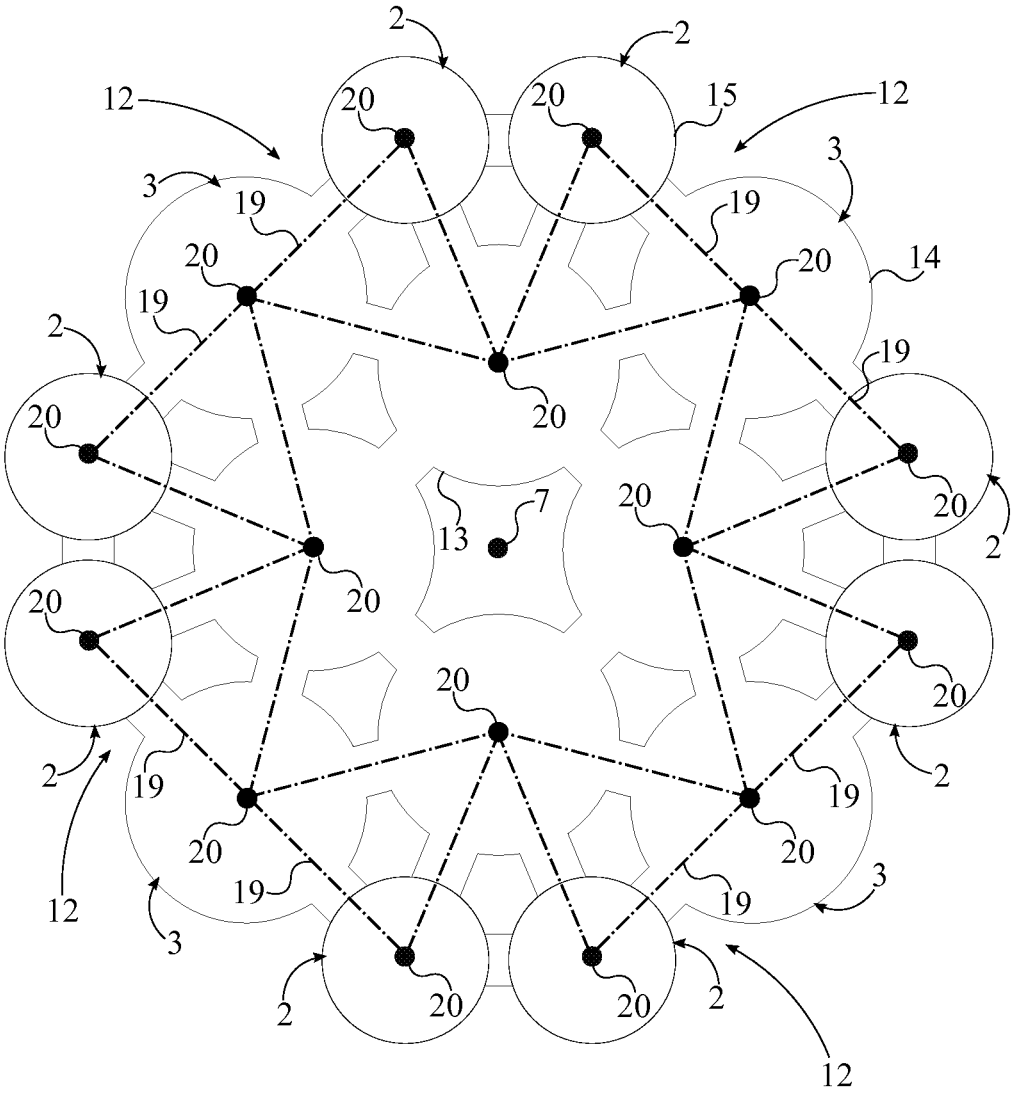
FIG. 14 is a top view of the hull of an alternative embodiment of the present invention which uses 8 flotation columns and 8 pontoons.

The present invention further comprises an anchoring system 9 which is tethered along the lateral portion 4 for each of the plurality of flotation columns 2. It is preferred that the anchoring system 9 is secured to the first base 5 of each of the plurality of flotation columns 2; however, the anchoring system 9 may alternatively be secured to the lateral portion 4 of each of the plurality of flotation columns 2. It is preferred that the anchoring system 9 tethers the hull 1 to the seabed through the use of one or more piles or gravity anchors; however, alternative methods may be used in alternative embodiments. In reference to FIG. 12, the present invention comprises a pontoon height 21 for each of the plurality of pontoons 3 and a column height 22 for each of the plurality of flotation columns 2. It is preferred that the pontoon height 21 is less than 80% of the column height 22. In reference to FIGS. 13-14, the number of flotation columns 2 and the number of pontoons 3 may be changed in alternative embodiments of the present invention. Moreover, the arrangement of the flotation columns 2 and the pontoons 3 may also be changed as needed for specific applications.

Although the invention has been explained in relation to its preferred embodiment, it is to be understood that many other possible modifications and variations can be made without departing from the spirit and scope of the invention as hereinafter claimed.

What is claimed is:

1. A multi-column tension leg platform comprises:

a hull;

a topside;

the hull comprises a plurality of flotation columns and a plurality of pontoons;

the plurality of flotation columns being positioned radially about a vertical central axis of the topside;

the plurality of pontoons being positioned radially about the vertical central axis of the topside;

a lateral portion for each of the plurality of flotation columns and a lateral portion for each of the plurality of pontoons being aligned parallel to the vertical central axis;

the plurality of pontoons being laterally mounted amongst the plurality of flotation columns;

a plurality of top-tensioned risers; and the plurality of top-tensioned risers being externally mounted to at least one of the plurality of pontoons.

2. The multi-column tension leg platform as claimed in claim 1 comprises:

the plurality of top-tensioned risers being mounted along the central vertical axis.

3. The multi-column tension leg platform as claimed in claim 1 comprises:

a plurality of catenary risers; and the plurality of catenary risers being mounted to at least one of the plurality of pontoons.

4. The multi-column tension leg platform as claimed in claim 1 comprises:

a plurality of catenary risers; and the plurality of catenary risers being mounted to at least one of the plurality of flotation columns.

5. The multi-column tension leg platform as claimed in claim 1 comprises:

each of the plurality of flotation columns and each of the plurality of pontoons each further comprise a first base and a second base;

the lateral portion being perpendicularly positioned between the first base and the second base; and the topside being mounted onto the first base of each of the plurality of flotation columns.

6. The multi-column tension leg platform as claimed in claim 1 comprises:

an anchoring system;

each of the plurality of flotation columns and each of the plurality of pontoons each comprise a first base, a second base, and a lateral portion;

the lateral portion being perpendicularly positioned between the first base and the second base; and the anchoring system being tethered along the lateral portion for each of the plurality of flotation columns.

7. The multi-column tension leg platform as claimed in claim 1 comprises:

a pontoon height for each of the plurality of pontoons;

a column height for each of the plurality of flotation columns; and the pontoon height being less than 80% of the column height.

8. The multi-column tension leg platform as claimed in claim 1 comprises:

the plurality of pontoons being positioned adjacent to each other; and the plurality of flotation columns being peripherally positioned about the plurality of pontoons.

9. The multi-column tension leg platform as claimed in claim 8 comprises:

a plurality of cells;

each of the plurality of cells comprises an arbitrary pontoon from the plurality of pontoons, an adjacent pontoon from the plurality of pontoons, and an adjacent column from the plurality of flotation columns;

the plurality of cells being radially positioned about the vertical central axis; and vertices of a triangular arrangement being coincident with central axes of the arbitrary pontoon, the adjacent pontoon, and the adjacent column.

10. The multi-column tension leg platform as claimed in claim 1 comprises:

the plurality of flotation columns being positioned adjacent to each other; and the plurality of pontoons being peripherally positioned about the plurality of flotation columns.

11. The multi-column tension leg platform as claimed in claim 10 comprises:

a plurality of cells;

each of the plurality of cells comprises an arbitrary column from the plurality of flotation columns, an adjacent column from the plurality of flotation columns, and an adjacent pontoon from the plurality of pontoons;

the plurality of cells being radially positioned about the vertical central axis; and vertices of a triangular arrangement being coincident with central axes of the arbitrary column, the adjacent column, and the adjacent pontoon.

12. A multi-column tension leg platform comprises:

a hull;

a topside;

a plurality of cells;

the hull comprises a plurality of flotation columns and a plurality of pontoons;

each of the plurality of cells comprises an arbitrary pontoon from the plurality of pontoons, an adjacent pontoon from the plurality of pontoons, and an adjacent column from the plurality of flotation columns;

the plurality of flotation columns being positioned radially about a vertical central axis of the topside;

the plurality of pontoons being positioned radially about the vertical central axis of the topside;

a lateral portion for each of the plurality of flotation columns and a lateral portion for each of the plurality of pontoons being aligned parallel to the vertical central axis;

the plurality of pontoons being laterally mounted amongst the plurality of flotation columns;

the plurality of pontoons being positioned adjacent to each other; and the plurality of flotation columns being peripherally positioned about the plurality of pontoons;

the plurality of cells being radially positioned about the vertical central axis;

vertices of a triangular arrangement being coincident with central axes of the arbitrary pontoon, the adjacent pontoon, and the adjacent column;

a plurality of top-tensioned risers; and the plurality of top-tensioned risers being externally mounted to at least one of the plurality of pontoons.

13. The multi-column tension leg platform as claimed in claim 12 comprises:

the plurality of top-tensioned risers being mounted along the central vertical axis.

14. The multi-column tension leg platform as claimed in claim 12 comprises:

a plurality of catenary risers; and the plurality of catenary risers being mounted to at least one of the plurality of pontoons.

15. The multi-column tension leg platform as claimed in claim 12 comprises:

a plurality of catenary risers; and the plurality of catenary risers being mounted to at least one of the plurality of flotation columns.

16. The multi-column tension leg platform as claimed in claim 12 comprises:

each of the plurality of flotation columns and each of the plurality of pontoons each further comprise a first base and a second base;

the lateral portion being perpendicularly positioned between the first base and the second base; and the topside being mounted onto the first base of each of the plurality of flotation columns.

17. The multi-column tension leg platform as claimed in claim 12 comprises:

an anchoring system;

each of the plurality of flotation columns and each of the plurality of pontoons each comprise a first base, a second base, and a lateral portion;

the lateral portion being perpendicularly positioned between the first base and the second base; and the anchoring system being tethered along the lateral portion for each of the plurality of flotation columns.

18. The multi-column tension leg platform as claimed in claim 12 comprises:

a pontoon height for each of the plurality of pontoons;

a column height for each of the plurality of flotation columns; and the pontoon height being less than 80% of the column height.

* * * * *